US010040282B2

(12) United States Patent
Arakane

(10) Patent No.: US 10,040,282 B2
(45) Date of Patent: Aug. 7, 2018

(54) PRINTER THAT SETS EJECTION TIMING BETWEEN NOZZLE GROUPS

(71) Applicant: BROTHER KOGYO KABUSHIKI KAISHA, Nagoya-shi, Aich-ken (JP)

(72) Inventor: Satoru Arakane, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/472,329

(22) Filed: Mar. 29, 2017

(65) Prior Publication Data

US 2018/0072053 A1 Mar. 15, 2018

(30) Foreign Application Priority Data

Sep. 9, 2016 (JP) ..... 2016-176544

(51) Int. Cl.
*B41J 2/045* (2006.01)

(52) U.S. Cl.
CPC ..... *B41J 2/04573* (2013.01); *B41J 2/04586* (2013.01)

(58) Field of Classification Search
CPC ..... B41J 2/04573; B41J 2/04586
See application file for complete search history.

(56) References Cited

U.S. PATENT DOCUMENTS 5,576,744 A * 11/1996 Niikura ..... B41J 2/04505 347/14
6,517,267 B1 * 2/2003 Otsuki ..... B41J 2/04581 347/14
2015/0145909 A1 * 5/2015 Marumoto ..... B41J 2/2132 347/9

FOREIGN PATENT DOCUMENTS

JP 3293707 B2 6/2002
JP 3313819 B2 8/2002
JP 2008-230069 A 10/2008

* cited by examiner

*Primary Examiner* — Bradley Thies
(74) *Attorney, Agent, or Firm* — Scully, Scott, Murphy & Presser, PC

(57) ABSTRACT

A controller performs an ejection-timing setting process of setting, for each of first and second nozzle groups, ejection timing in scan printing in which a liquid ejection head ejects a liquid droplet while a head moving device moves the head in a scanning direction. The process includes: in response to receiving a first signal, setting ejection timing such that a time difference between ejection timing of the first nozzle group and ejection timing of the second nozzle group is first time, the first signal instructing printing such that a conveyance amount of a medium between successive two-time scan printing is a first conveyance amount; and in response to receiving a second signal, setting ejection timing such that the time difference is second time shorter than the first time, the second signal instructing printing such that the conveyance amount is a second conveyance amount smaller than the first conveyance amount.

11 Claims, 11 Drawing Sheets

PRINTER THAT SETS EJECTION TIMING BETWEEN NOZZLE GROUPS

CROSS REFERENCE TO RELATED APPLICATIONS

This application claims priority from Japanese Patent Application No. 2016-176544 filed Sep. 9, 2016. The entire content of the priority application is incorporated herein by reference.

TECHNICAL FIELD

This disclosure relates to a printer that ejects liquid from nozzles to print on a recording medium.

BACKGROUND

As an example of the printer for printing on a recording medium, an inkjet recording apparatus that ejects ink from nozzles for printing is disclosed. The inkjet recording medium is of a so-called serial-type inkjet printer, and prints an image by repeating scan printing that discharge ink from nozzles while moving a head in the scanning direction and conveyance of a recording sheet. In this printer, there is deviation of landing position of ink droplets in the scanning direction at the upstream side and downstream side in the conveyance direction of the recording medium (paper sheet) caused by different distances between the nozzles and the recording medium. As a countermeasure for the deviation of landing position, ejection timing of the upstream nozzles and the downstream nozzles out of a plurality of nozzles arrayed in the conveyance direction are changed.

SUMMARY

According to one aspect, this specification discloses a printer. The printer includes a conveyor, a liquid ejection head, a head moving device, and a controller. The conveyor is configured to convey a recording medium in a conveyance direction. The liquid ejection head has: a first nozzle group formed by one or a plurality of nozzles arrayed continuously in the conveyance direction; and a second nozzle group located adjacent to a downstream side of the first nozzle group in the conveyance direction, the second nozzle group being formed by one or a plurality of nozzles arrayed continuously in the conveyance direction. The head moving device is configured to move the liquid ejection head in a scanning direction intersecting the conveyance direction. The controller is configured to control the conveyor, the liquid ejection head, and the head moving device. The controller is configured to perform an ejection-timing setting process of setting, for each of the first nozzle group and the second nozzle group, ejection timing in scan printing in which the liquid ejection head ejects a liquid droplet from the plurality of nozzles while the head moving device moves the liquid ejection head in the scanning direction. The ejection-timing setting process includes: in response to receiving a first signal, setting the ejection timing such that a time difference between the ejection timing of the first nozzle group and the ejection timing of the second nozzle group is first time, the first signal instructing printing such that a conveyance amount of the recording medium by the conveyor between successive two-time scan printing is a first conveyance amount; and in response to receiving a second signal, setting the ejection timing such that the time difference is second time shorter than the first time, the second signal instructing printing such that the conveyance amount is a second conveyance amount smaller than the first conveyance amount.

BRIEF DESCRIPTION OF THE DRAWINGS

Embodiments in accordance with this disclosure will be described in detail with reference to the following figures wherein.

DETAILED DESCRIPTION

In the above-described serial-type inkjet printer, the conveyance-amount of the sheet is changed depending on, for example, the resolution of the image to be printed. For instance, when printing a high-resolution image, so-called "interlace printing" is performed in a manner where a conveyance amount of the sheet is made smaller than that when printing a low-resolution image and two scanning ranges of the image that have been scanned by successive two-time scan printing are overlapped.

When the conveyance amount of the sheet is large, the overlap width of the above two scanning ranges in the conveyance direction is small (or no overlap width). Thus, deviation of landing position of ink droplets in the scanning direction between the two scanning ranges is easy to notice. When the conveyance amount of the sheet is small, the above-mentioned overlap width is large thereby the deviation of landing position of ink droplets in the scanning direction between the two scanning ranges is less easy to notice. Moreover, if the ejection-timing is changed between the upstream side nozzles and the downstream side nozzles in the same way as the case that conveyance-amount of the sheet is large, unnecessary deviation of landing position is produced, which may result in deterioration of image quality. Accordingly, it is not preferable to change the ejection timing between the upstream side nozzles and the downstream side nozzles uniformly regardless of the conveyance amount of a recording medium. However, a relation between the conveyance amount of the sheet and a method of changing ejection timing of the upstream side nozzles and the downstream side nozzles are not disclosed.

In addition, the plurality of nozzles arrayed in the conveyance direction is divided into two nozzle groups, i.e. upstream side nozzles and downstream side nozzles, and changes the ejection timing between the two nozzle groups. It may be possible to group the plurality of nozzles arrayed in the conveyance direction into three or more nozzle groups and to change ejection timing between adjacent nozzle groups. In such a case, it is not preferable to change the ejection timing between the adjacent nozzle groups uniformly regardless the conveyance amount of the recording medium in a manner similar to the above.

An example of an object of this disclosure is to provide a printer that appropriately sets ejection timing between nozzle groups depending on noticeability of deviation of droplet landing position caused by a difference of a conveyance amount of a recording medium.

An aspect of this disclosure will be described while referring to the accompanying drawings.

<Overall Configuration of Inkjet Printer>

Figure 1:
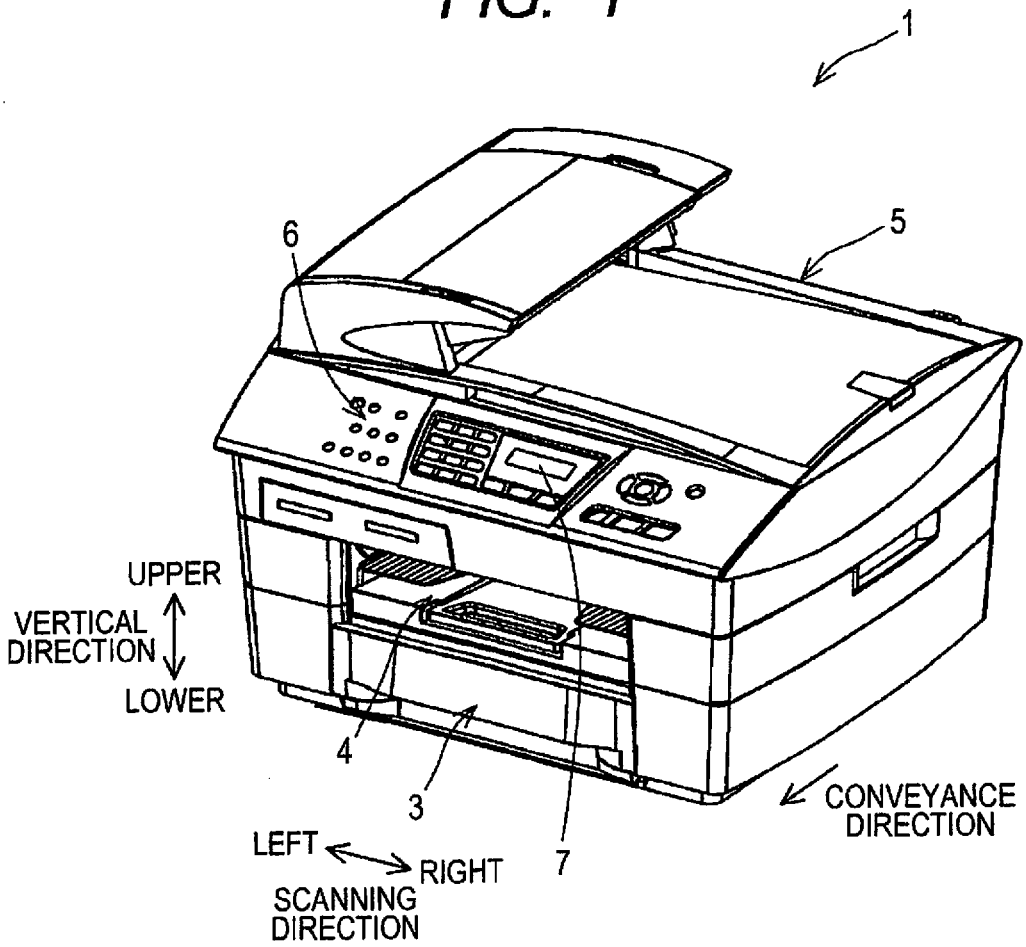
FIG. 1 is a schematic view of a multifunction peripheral (MFP) according to an embodiment of this disclosure.

The inkjet printer 1 (an example of a printer) is a so-called multifunction peripheral (MFP) that prints an image on a recording sheet P (an example of a recording medium), and also scans an image. As shown in FIG. 1, the inkjet printer 1 includes a printer section 2 (see FIG. 2), a feeder 3, a discharge section 4, a reader 5, an operating interface 6, and a display 7. Operations of the inkjet printer 1 are controlled by a controller 50 (see FIG. 5).

The printer section 2 is provided inside the inkjet printer 1 to perform printing on a recording sheet P. The printer section 2 will be described in detail later. The feeder 3 feeds the recording sheet P to the printer section 2. The discharge section 4 is a part where the recording sheet P on which printing has been performed by the printer section 2 is discharged. The reader 5 is a scanner or the like and is capable of reading an original document. The operating interface 6 is provided with buttons and so on, and a user performs necessary operation to the inkjet printer 1 by operating buttons of the operating interface 6. The display 7 is a liquid crystal display or the like, and displays information needed during operations of the inkjet printer 1.

<Printer Section>

Figure 2:
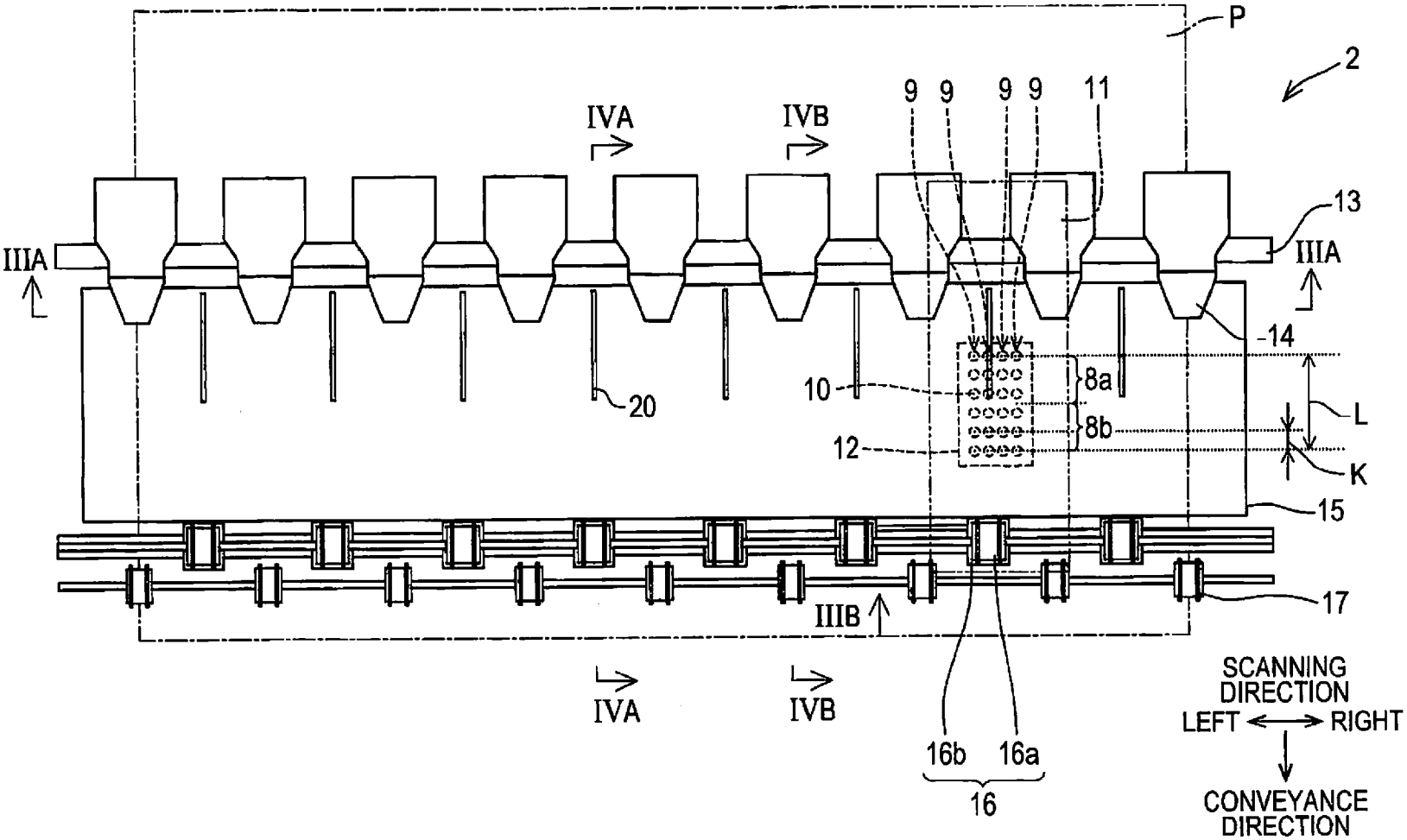
FIG. 2 is a plan view of a printer section of FIG. 1.

Next, the printer section 2 will be described. As shown in FIGS. 2 to 4B, the printer section 2 includes a carriage 11, an inkjet head 12 (an example of a liquid ejection head), a conveyance roller 13, a platen 15, nine corrugate plates 14 (an example of an upstream-side contactable member), eight discharge rollers 16, and nine corrugated spurs 17 (an example of a downstream-side contactable member). In FIG. 2, the carriage 11 is shown by a two-dot chain line in order to make the corrugate plates 14, the below-described rib 20, and so on more visible, and the members arranged under the carriage and hidden by the carriage 11 is shown by a solid line. In addition, in FIG. 2, illustration of, for example, a guide rail for supporting the carriage is omitted.

The carriage 11 is supported by the guide rail (not shown) so as to be movable in the scanning direction. The carriage 11 is connected to a carriage motor 56 (see FIG. 5) through a belt and so on (not shown). When the carriage motor 56 is driven, the carriage 11 moves in the scanning direction. In this embodiment, a combination of: the carriage 11; the guide rail for supporting the carriage 11, the carriage motor 56, the belt and so on (not shown) for connecting the carriage motor 56 and the carriage 11 serves as a head moving device. Hereinafter, the right side and the left side in the scanning direction are defined as shown in FIGS. 1 and 2.

The inkjet head 12 is mounted on the carriage 11, and reciprocates in the scanning direction together with the carriage 11. The inkjet head 12 ejects ink from a plurality of nozzles 10 formed on an ink ejection face 12*a* that is the lower surface of the inkjet head 12. The plurality of nozzles 10 is arranged at an interval K over a length L in a conveyance direction perpendicular to the scanning direction, thereby forming a nozzle array 9. In the inkjet head 12, four nozzle arrays 9 are arranged in the scanning direction. The plurality of the nozzles 10 in each nozzle array 9 ejects ink in black, yellow, cyan, and magenta, from the rightmost nozzle array 9 in this order.

Figure 5:
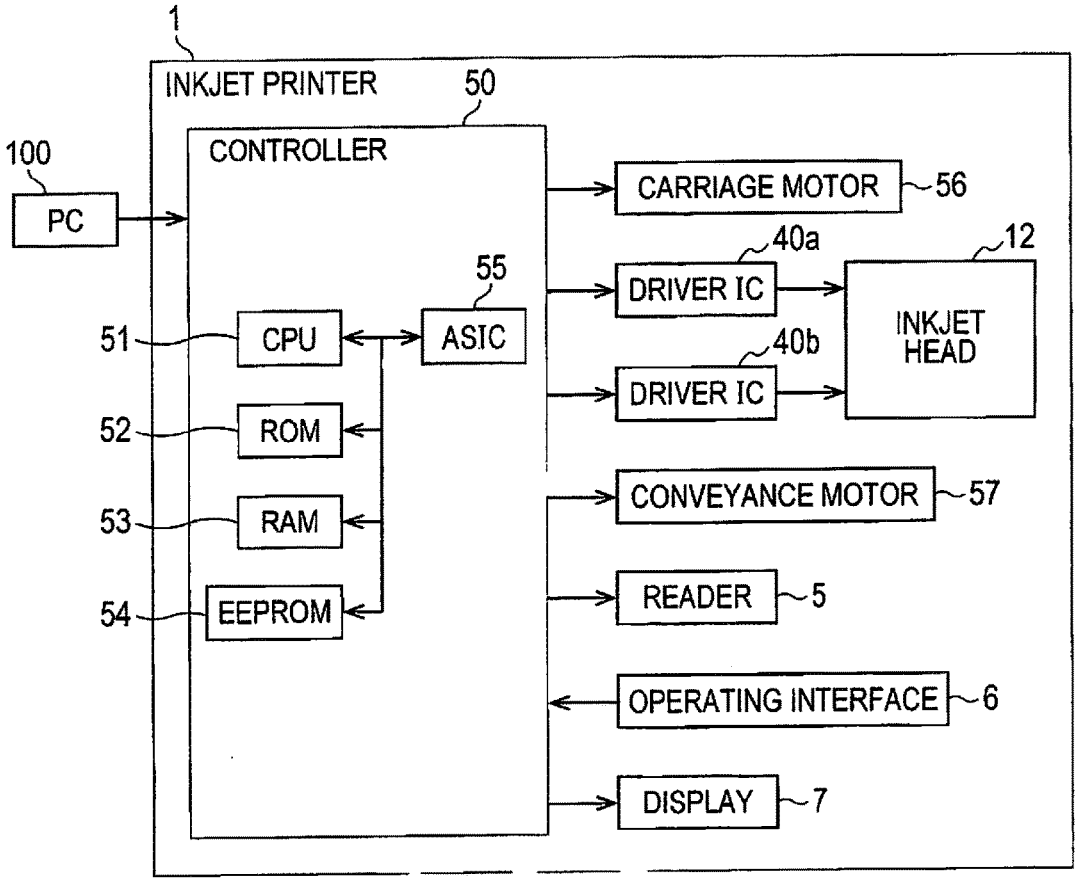
FIG. 5 is a block diagram showing an electrical configuration of the MFP.

The inkjet head 12 is driven by two driver ICs 40*a*, 40*b* (see FIG. 5). The driver IC 40*a* drives the inkjet head 12 such that ink is ejected from the nozzles 10 forming a first nozzle group 8*a* which is the upstream half of the nozzle array 9 in the conveyance direction. The driver IC 40*b* drives the inkjet head 12 such that ink is ejected from the nozzles 10 forming a second nozzle group 8*b* which is the downstream half of the nozzle array 9. Accordingly, in the embodiment, ink ejection timing can be set individually by using the nozzles 10 forming the first nozzle group 8*a* and other nozzles 10 forming the second nozzle group 8*b*. The number of nozzles 10 forming the first nozzle group 8*a* is the same as the other nozzles 10 forming the second nozzle group 8*b*.

The conveyance roller 13 is arranged at an upstream side of the inkjet head 12 in the conveyance direction. The conveyance roller 13 has an upper roller 13*a* and a lower roller 13*b*, and nips the recording sheet P fed from the feeder 3 by using these rollers from up and down and conveys the recording sheet P in the conveyance direction. The upper roller 13*a* is driven by a conveyance motor 57 (see FIG. 5). The lower roller 13*b* rotates along with rotation of the upper roller 13*a*.

Each of the nine corrugate plates 14 extends from a position overlapping the conveyance roller 13 to a position at a downstream side of the conveyance roller 13 in the conveyance direction. The nine corrugate plates 14 are arranged at an equal interval in the scanning direction. Each corrugate plate 14 has a presser portion 14*a* at a downstream end in the conveyance direction, and presses (contacts) the recording sheet P from above by the presser portion 14*a*.

As shown in FIG. 2, the platen 15 is arranged to face the ink ejection surface 12*a* at a downstream side of the conveyance roller 13 in the conveyance direction. The platen 15 extends in the scanning direction over an entire length of a moving range of the carriage 11 in printing. Eight ribs 20 are formed on the upper surface of the platen 15. Each of the eight ribs 20 extends in the conveyance direction. The eight ribs 20 are arranged at an equal interval in the scanning direction, such that each rib 20 is located between the adjacent corrugate plates 14. The ribs 20 support the recording sheet P from below.

Figure 3A:
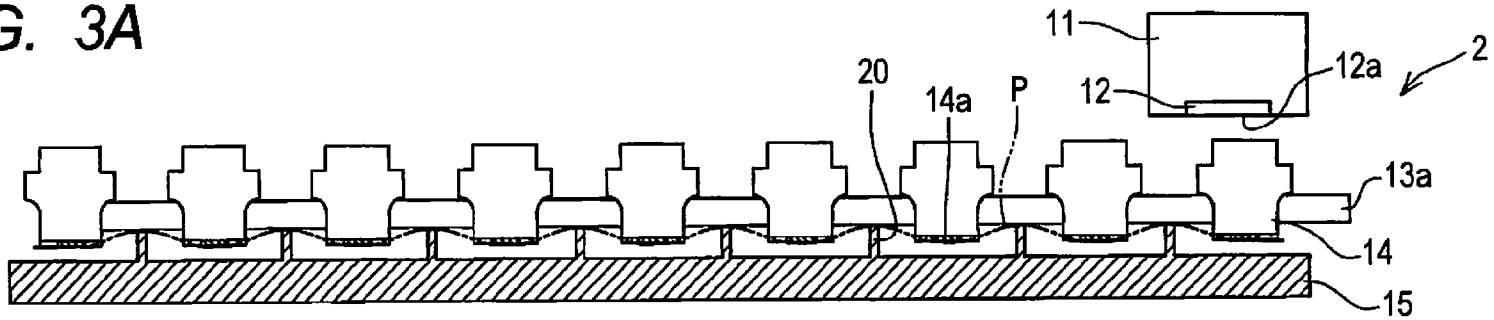
FIG. 3A is a cross-sectional view taken along a line IIIA-IIIA in FIG. 2.

As shown in FIG. 3A, the upper end of the rib 20 is located at a higher position than the presser portion 14*a*. With this configuration, the rib 20 supports the recording sheet P, from below, at a position higher than the position where the presser portion 14*a* presses the recording sheet P.

The eight discharge rollers 16 are arranged at a downstream side of the inkjet head 12 in the conveyance direction. The positions of the discharge rollers 16 in the scanning direction are almost the same as the positions of the ribs 20 in the scanning direction. Each discharge roller 16 has an upper roller 16*a* and a lower roller 16*b*, and nips the recording sheet P by these rollers from up and down and conveys the recording sheet P in the conveyance direction. The discharge roller 16 conveys the recording sheet P in the conveyance direction toward the discharge section 4. The lower roller 16*b* is driven by the conveyance motor 57 (see FIG. 5). The upper roller 16*a* is a spur, and rotates along with rotation of the lower roller 16*b*. Here, the upper roller 16*a* contacts a print surface of the recording sheet P after printing. However, because the upper roller 16*a* is a spur, not a roller having a smooth outer circumferential surface, ink on the recording sheet P does not easily adhere to the upper roller 16*a*. In the embodiment, a combination of the conveyance roller 13 and the discharge roller 16 that convey the recording sheet P serves as a conveyor.

The nine corrugate spurs 17 are arranged at a downstream side of the discharge rollers 16 in the conveyance direction, and press (contact) the recording sheet P from above. The positions of the nine corrugate spurs 17 in the scanning direction are almost the same as the positions of the presser portions 14*a* of the nine corrugate plates 14 in the scanning direction. The lower end of each corrugate spur 17 is located at a lower position than a position where the recording sheet P is nipped by the upper roller 16*a* and the lower roller 16*b*. With this configuration, the lower roller 16*b* of the discharge roller 16 supports, from below, the recording sheet P at a position higher than the corrugate spur 17. Because the corrugate spur 17 is a spur, not a roller having a smooth outer circumferential surface, ink on the recording sheet P does not easily adhere to the corrugate spur 17.

Note that the numbers of the corrugate plate 14, the discharge roller 16, the rib 20, and the corrugate spur 17 are just an example, and these numbers may be different from those described above.

Figure 3B:
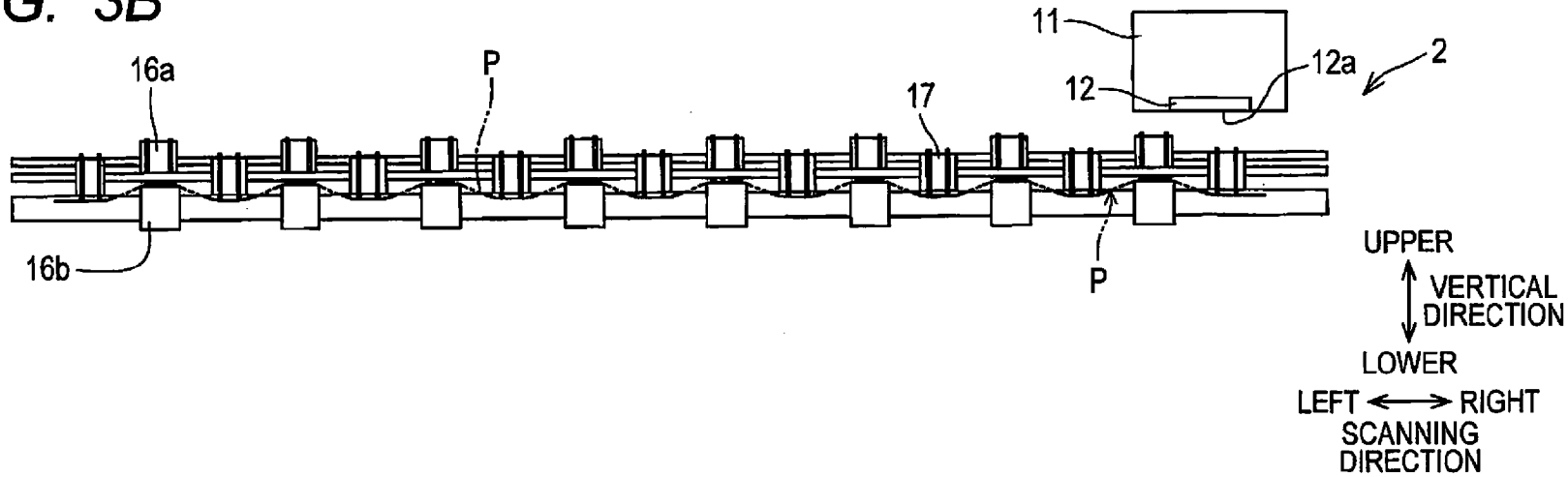
FIG. 3B is a diagram viewed from a direction indicated by an arrow IIIB in FIG. 2.
Figures 4A, 4B:
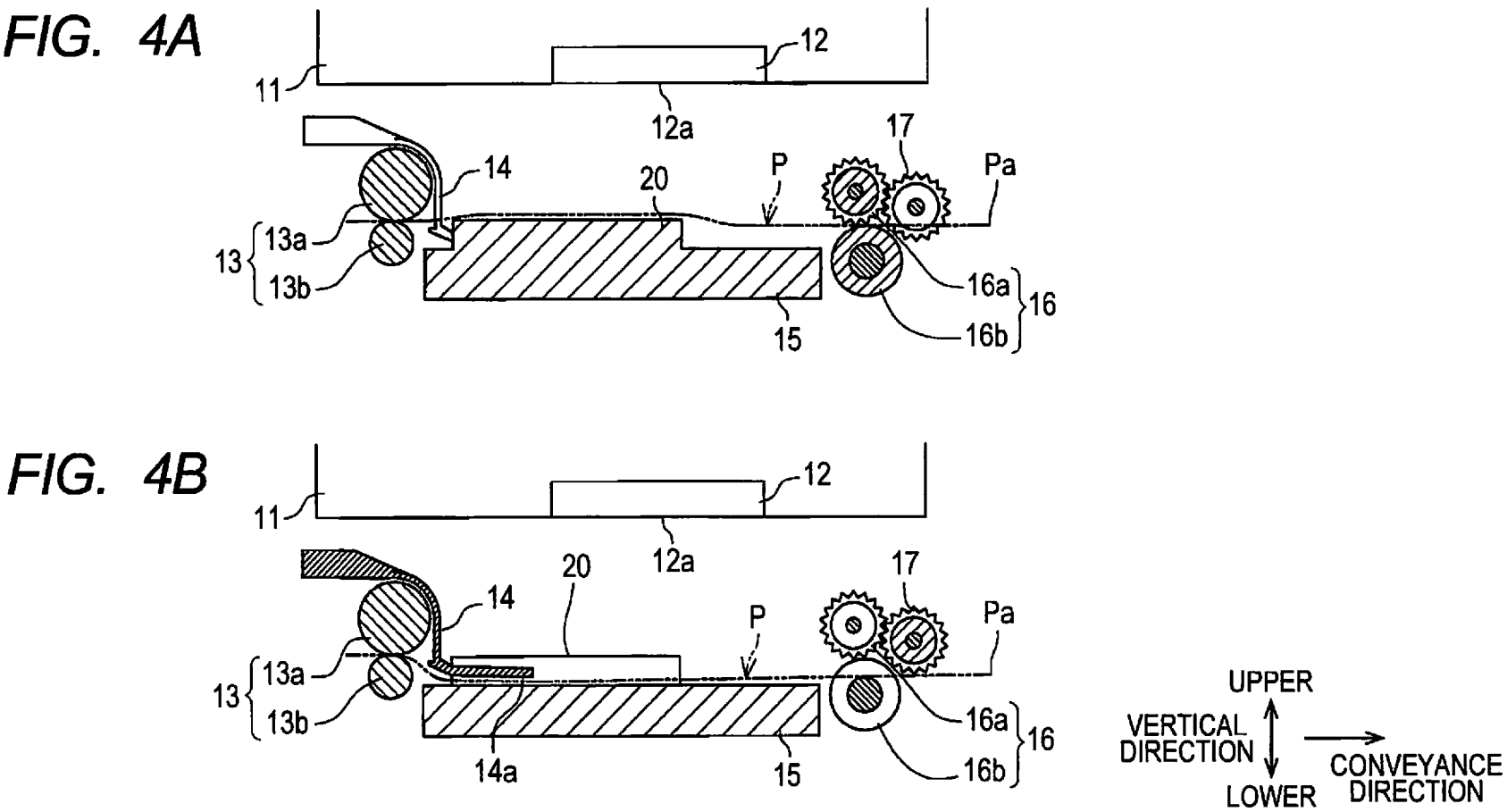
FIG. 4A is a cross-sectional view taken along a line IVA-IVA of FIG. 2.
FIG. 4B is a cross-sectional view taken along a line IVB-IVB of FIG. 2.

As shown in FIGS. 3A and 3B, the recording sheet P is supported, from below, by the eight ribs 20 and the eight lower rollers 16*b*, and is pressed, from above, by the presser portions 14*a* of the nine corrugate plates 14 and the nine corrugate spurs 17. Thereby, the recording sheet P is bent and has a corrugated shape (a wave shape) along the scanning direction. Here, the force by which the corrugate spur 17 presses the recording sheet P is smaller than the force by which the corrugate plate 14 presses the recording sheet P, such that ink adhered to the recording sheet P in printing does not easily adhere to the upper roller 16*a* and the corrugate spur 17.

<Controller>

Next, the controller 50 for controlling operations of the inkjet printer 1 will be described. As shown in FIG. 5, the controller 50 includes a CPU (Central Processing Unit) 51, a ROM (Read Only Memory) 52, a RAM (Random Access Memory) 53, an EEPROM (Electrically Erasable Programmable Read Only Memory) 54, an ASIC (Application Specific Integrated Circuit) 55, and so on, and these control operations of the carriage motor 56, the driver ICs 40*a*, 40*b*, the conveyance motor 57, the reader 5, the display 7, and so on. Signals and so on corresponding to operations on the operating interface 6 are inputted to the controller 50.

FIG. 5 shows only one CPU 51. The controller 50 may include only one CPU 51 and the one CPU 51 may perform processes collectively. The controller 50 may include a plurality of CPUs 51 and the plurality of CPUs 51 may perform processes by sharing. FIG. 5 shows only one ASIC 55. The controller 50 includes only one ASIC 55 and the one ASIC 55 may perform processes collectively. The controller 50 may include a plurality of ASICs 55 and the plurality of ASICs 55 may perform processes by sharing.

<Operations in Printing>

Next, operations at the time when the printer section 2 performs printing on a recording sheet P will be described. The printer section 2 performs printing on a recording sheet P by repeating scan printing and a sheet conveyance operation. In the scan printing, while the carriage motor 56 is controlled to move the carriage 11 in the scanning direction, the inkjet head 12 (the driver ICs 40*a*, 40*b*) is controlled to eject ink from the plurality of nozzles 10. In the sheet conveyance operation, the conveyance motor 57 is controlled to convey the recording sheet P by the rollers 13, 16.

The printer section 2 selectively performs one of printing of an image of a reference resolution (for example, 300 dpi) in which the resolution in the conveyance direction corresponds to the interval K of the nozzles 10, and printing of such an image that the resolution in the conveyance direction is twice the reference resolution (for example, 600 dpi) which is called as interlaced printing. Here, the reference resolution corresponding to the interval K of the nozzles 10 is such a resolution that dots are arrayed at the interval K of the nozzles 10 in the conveyance direction.

Figure 6A:
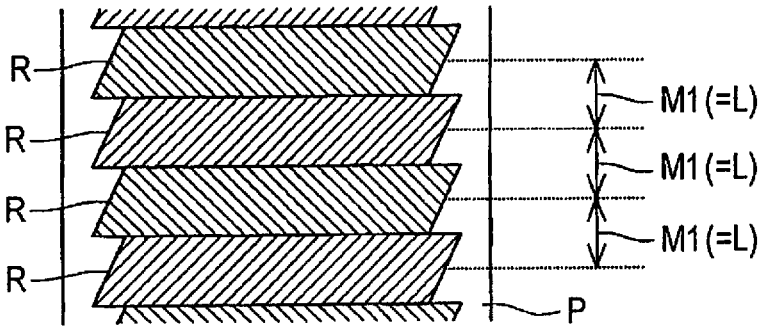
FIG. 6A is a diagram showing a scanning range in printing when a first signal is inputted.
Figure 6B:
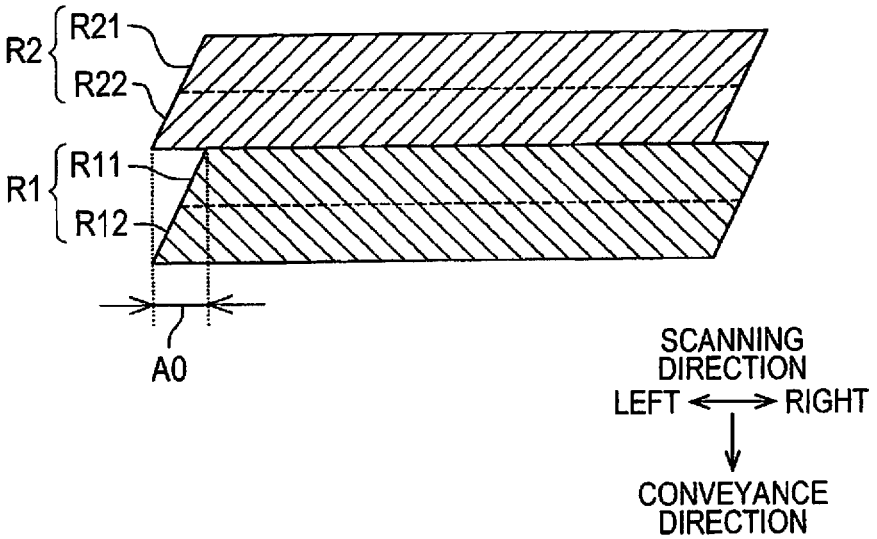
FIG. 6B is a diagram showing two scanning ranges created by successive two-time scan printing taken out from a plurality of the scanning ranges in FIG. 6A.

When the printer 1 prints such an image that the resolution in the conveyance direction is the reference resolution, in the above-described sheet conveyance operation, the recording sheet P is conveyed by a first conveyance amount M1 that is the same length as the length L of the nozzle array 9. As shown in FIGS. 6A and 6B, in two scanning ranges R1 and R2 on the recording sheet P scanned by successive two-time scan printing out of a plurality of scanning ranges R scanned by a plurality times of scan printing, the position in the conveyance direction of an upstream end of the scanning range R1 scanned by previous scan printing is the same as the position in the conveyance direction of a downstream end of the scanning range R2 scanned by subsequent scan printing. That is, the scanning range R1 and the scanning range R2 do not overlap each other. Note that FIGS. 6A and 6B show a case where the ejection timing of the nozzle group 8*a* and the nozzle group 8*b* in scan printing is the same.

Figure 7A:
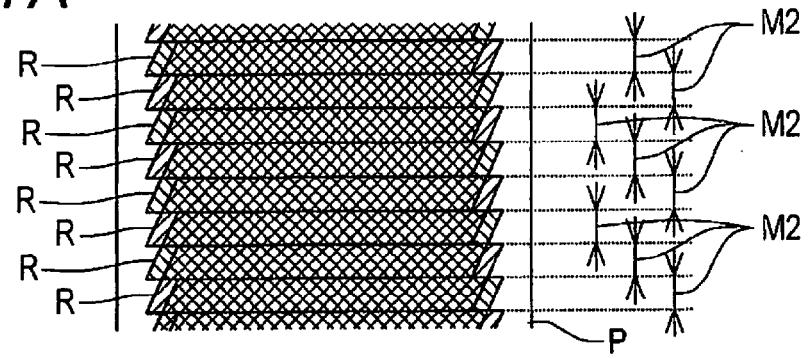
FIG. 7A is a diagram showing a scanning range in a case where ejection-timing is not changed between two nozzle groups and the first signal is inputted.
Figure 7B:
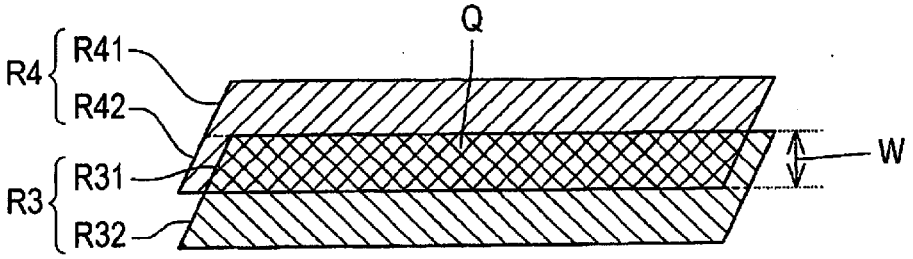
FIG. 7B is a diagram showing two scanning range created by successive two-time scan printing taken out of a plurality of the scanning ranges in FIG. 7A.

In contrast, when the printer 1 prints such an image that the resolution in the conveyance direction is higher than the reference resolution, in the sheet conveyance operation the recording sheet P is conveyed by a second conveyance amount M2 that is a length of approximately half of the length L of the nozzle array 9. More specifically, the second conveyance amount M2 is M2=(L/2) when the number of the nozzles 10 forming the nozzle array 9 is an even number, and is M2=[(L/2)+(K/2)] or M2=[(L/2)−(K/2)] when the number of the nozzles 10 forming the nozzle array 9 is an odd number. Thus, as shown in FIGS. 7A and 7B, in two scanning ranges R3 and R4 on the recording sheet P scanned by successive two-time scan printing out of a plurality of scanning ranges scanned by a plurality of times of scan printing, a portion R31 corresponding to the nozzle group 8*a* of the scanning range R3 scanned by previous scan printing overlaps a portion R42 corresponding to the nozzle group 8*b* of the scanning range R4 scanned by subsequent scan printing. That is, an overlap width W of the two scanning ranges R3, R4 in the conveyance direction is larger than an overlap width (=0) of the two scanning ranges R1, R2 in the conveyance direction.

In the present embodiment, as described above, the force applied to the recording sheet P by the corrugate spur 17 is smaller than the force applied to the recording sheet P by the presser portion 14*a* of the corrugate plate 14. Hence, a distance between the ink ejection surface 12*a* and the recording sheet P is larger at an upstream side in the conveyance direction, than the distance at a downstream side in the conveyance direction. Accordingly, in scan printing, a droplet landing position on the recording sheet P of ink ejected from the nozzles 10 at the upstream side in the conveyance direction is deviated, from an ejection position of ink, toward the downstream side in the moving direction of the carriage 11. As a result, as the nozzles 10 are farther away from each other in the conveyance direction, the droplet landing positions of ink are deviated at a larger distance in the scanning direction.

As described above, when printing such an image that the resolution in the conveyance direction is the reference resolution, the position in the conveyance direction of the upstream end of the scanning range R1 at which dots are formed by ink ejected from the nozzle 10 at the farthest upstream side is the same as the position in the conveyance direction of the downstream end of the scanning range R2 at which dots are formed by ink ejected from the nozzle 10 at the farthest downstream side. Hence, as shown in FIG. 6B, deviation in droplet landing positions in the scanning direction between the scanning range R1 and the scanning range R2 is easy to notice. Here, FIGS. 6A and 6B shows a case of so-called unidirectional printing in which ink is ejected from the nozzles 10 only when the carriage 11 is moved from the left side to the right side in scan printing. On the other hand, when performing so-called bidirectional printing in which ink is ejected from the nozzles 10 when the carriage 11 is moved to each side in the scanning direction in scan printing, too, deviation in droplet landing positions in the scanning direction between the two scanning ranges R1, R2 is easy to notice.

Figure 7C:
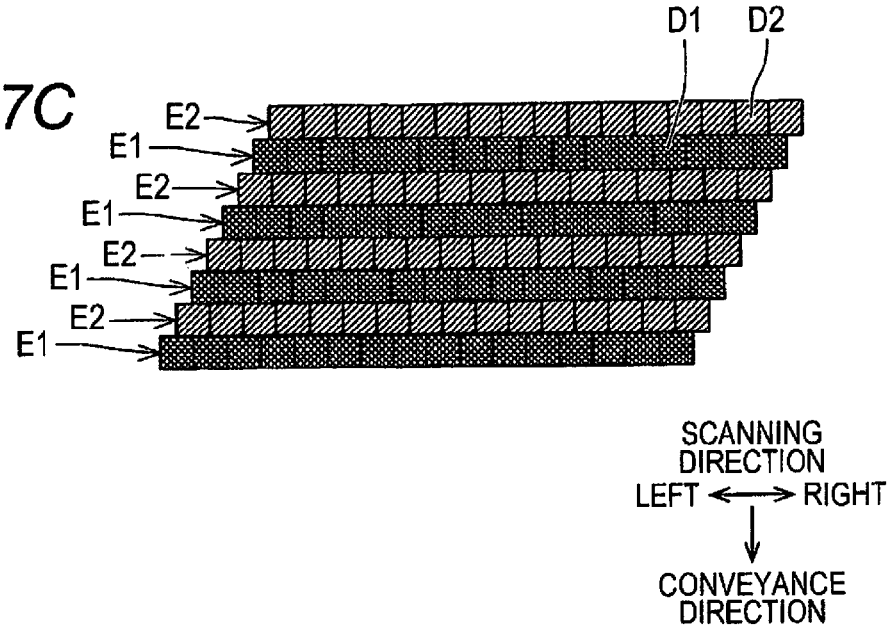
FIG. 7C is a diagram showing a dot arrangement in an overlap portion in FIG. 7B.

When printing such an image that the resolution in the conveyance direction is higher than the reference resolution, the scanning range R3 and the scanning range R4 overlap each other. As shown in FIG. 7C, in an overlapping portion Q of the scanning range R3 and the scanning range R4, dot arrays E1 and dot arrays E2 are arranged alternately in the conveyance direction. In each dot array E1, dots D1 formed in previous scan printing are arrayed in the scanning direction. In each dot array E2, dots D2 formed in subsequent scan printing are arrayed in the scanning direction. That is, in the overlapping portion Q, the dots D1 formed in previous scan printing and the dots D2 formed in subsequent scan printing are mixed. Hence, deviation, in the scanning direction, in droplet landing positions between the scanning range R3 and the scanning range R4 is not easily noticed. Note that, in FIG. 7C, the dot D1 and the dot D2 are shown by different hatching patterns.

Thus, in the present embodiment, at the time of printing by the printer section 2, the controller 50 performs the following control based on a difference of a resolution of an image to be printed, in the conveyance direction.

Printing by the printer section 2 is started when a print command is inputted to the controller 50 from an external PC 100 connected to the inkjet printer 1. The print command includes image data of an image to be printed and either one of a first signal and a second signal. The first signal is a signal that instructs printing of such an image that the resolution in the conveyance direction is the reference resolution. The second signal is a signal that instructs printing of such an image that the resolution in the conveyance direction is higher than the reference resolution. For example, each of the first and second signals is a signal indicative of the resolution of an image to be printed (600×300 dpi, 1200×600 dpi, and so on), a signal indicative of a print mode (draft, normal, best, and so on), or a signal indicative of a type of a recording sheet P (normal paper, glossy paper, and so on).

Figure 8:
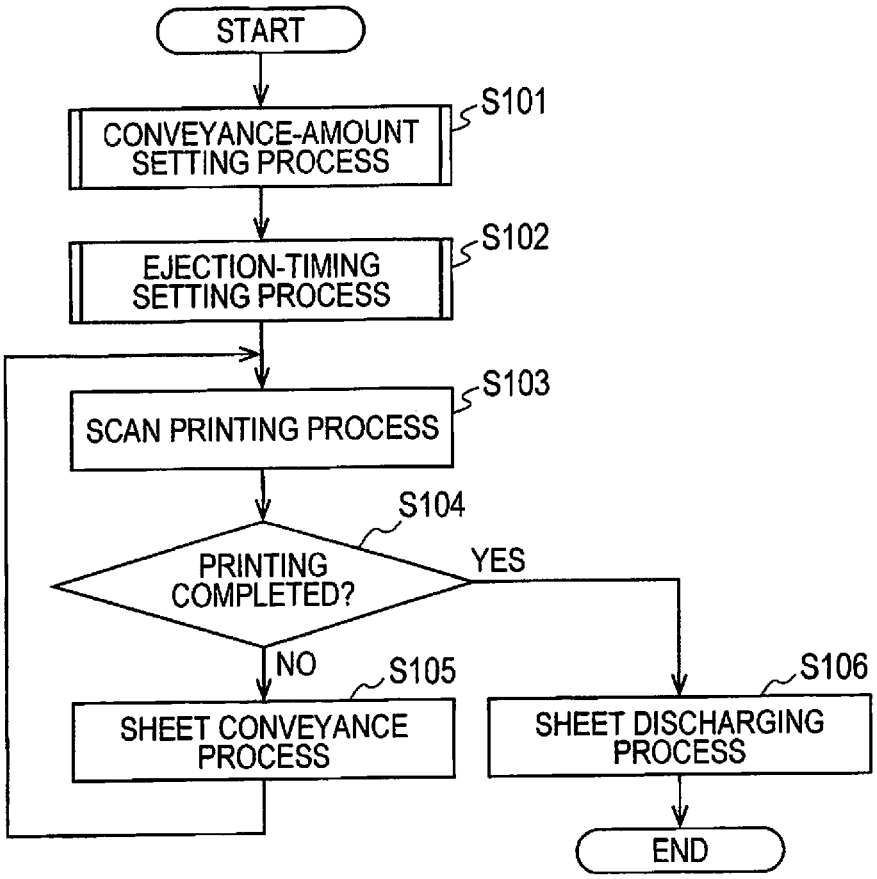
FIG. 8 is a flowchart showing a process flow when the printer section performs printing.
Figure 9A:
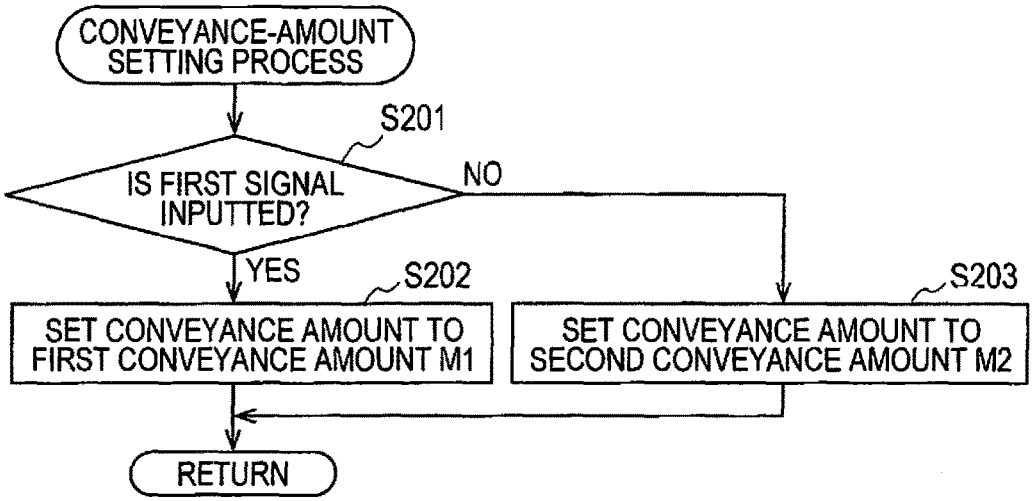
FIG. 9A is a flowchart showing a flow of a conveyance-amount setting process of FIG. 8.

When a print command is inputted, as shown in FIG. 8, the controller 50 first performs a conveyance-amount setting process of setting a conveyance amount M of a recording sheet P in a sheet conveyance operation (S101). In the conveyance-amount setting process, as shown in FIG. 9A, if the first signal is inputted (S201: YES), the controller 50 sets the conveyance amount M to a first conveyance amount M1 (S202). If the second signal is inputted (S201: NO), the controller 50 sets the conveyance amount M to a second conveyance amount M2 (S203). The values of the first conveyance amount M1 and the second conveyance amount M2 are stored in the EEPROM 54 at the time of manufacture of the inkjet printer 1, for example. The first conveyance amount M1 and the second conveyance amount M2 are read out from the EEPROM 54 in S202 and S203, respectively, and the conveyance amount M is set.

Figure 9B:
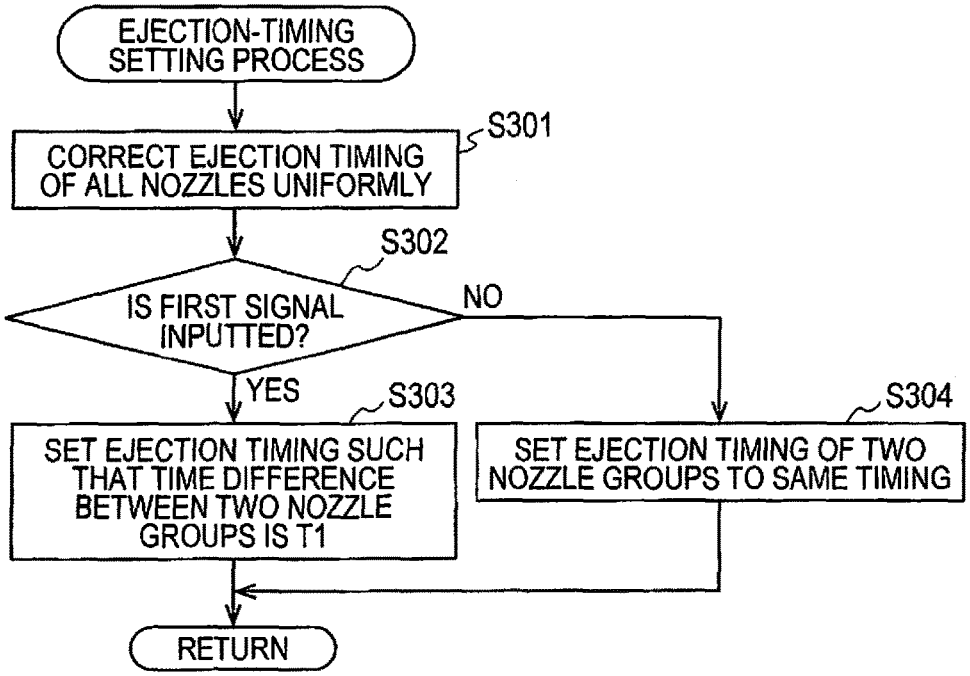
FIG. 9B is a flowchart showing a flow of an ejection-timing setting process of FIG. 8.

Returning to FIG. 8, the controller 50 subsequently performs an ejection-timing setting process of setting ejection timing in scan printing (S102). In the ejection-timing setting process, as shown in FIG. 9B, first, the controller 50 corrects the ejection timing of all the nozzles 10 uniformly from a reference timing (S301). The correction of ejection timing in S301 is, for example, correction of ejection timing for various factors such as variation of a distance between the ink ejection surface 12*a* and the recording sheet P in the scanning direction due to a corrugated shape of the recording sheet P along the scanning direction, expansion and contraction of the recording sheet P in the scanning direction, and so on. The reference timing is, for example, ejection timing in which it is assumed that the distance between the ink ejection surface 12*a* and the recording sheet P is constant regardless of the position in the conveyance direction.

Next, if the first signal is inputted (S302: YES), the ejection timing of the nozzle groups 8*a*, 8*b* is set such that the ejection timing of the second nozzle group 8*b* is delayed from the ejection timing of the first nozzle group 8*a* by first time T1 (S303). That is, the ejection timing is set such that a time difference of the ejection timing of the first nozzle group 8*a* and the second nozzle group 8*b* is the first time T1.

Specifically, the ejection timing of the nozzle group 8*a* is set to the ejection timing corrected in S301, and the ejection timing of the nozzle group 8*b* is set to the ejection timing that is delayed from the ejection timing corrected in S301 by the first time T1. Alternatively, the ejection timing of the nozzle group 8*a* may be set to the ejection timing that is advanced from the ejection timing corrected in S301 by the first time T1, and the ejection timing of the nozzle group 8*b* may be set to the ejection timing corrected in S301. Alternatively, the ejection timing of the nozzle groups 8*a*, 8*b* may be shifted from the ejection timing of S301 by different times from each other, such that the ejection timing of the second nozzle group 8*b* is delayed from the ejection timing of the first nozzle group 8*a* by the first time T1.

For example, at the time of manufacture of the inkjet printer 1 and so on, a particular test pattern is printed by the printer section 2. Based on a print result of the printed test pattern, the controller 50 calculates a parameter corresponding to the first time T1 and stores the parameter in the EEPROM 54. In S303, the controller 50 reads out the parameter from the EEPROM 54, and sets the ejection timing of the nozzle groups 8*a*, 8*b* to the above-described ejection timing based on the read parameter.

If the second signal is inputted (S302: NO), the controller 50 sets the ejection timing of the first nozzle group 8*a* and the second nozzle group 8*b* to the same ejection timing (S304). For example, the controller 50 sets the ejection timing of the first nozzle group 8*a* and the second nozzle group 8*b* to the ejection timing corrected in S301. That is, the ejection timing is set such that the time difference of the ejection timing of the first nozzle group 8*a* and the second nozzle group 8*b* is zero (an example of second time shorter than the first time T1).

Returning to FIG. 8, the controller 50 subsequently performs a scan printing process of performing scan printing (S103). At this time, the controller 50 controls the driver ICs 40*a*, 40*b* to eject ink from the nozzles 10 forming the first nozzle group 8*a* and the nozzles 10 forming the second nozzle group 8*b* at the ejection timing set in S102.

Subsequently, if printing on the recording sheet P is not completed (S104: NO), the controller 50 performs a sheet conveyance process of performing a sheet conveyance operation (S105), and then returns to S103. In S105, the controller 50 controls the conveyance motor 57 to convey the recording sheet P by the conveyance amount M (the first conveyance amount M1 or the second conveyance amount M2) determined in S101. If printing on the recording sheet P is completed (S104: YES), the controller 50 controls the conveyance motor 57 such that the rollers 13, 16 convey the recording sheet P in the conveyance direction, thereby discharging the recording sheet P to the discharge section 4 (S106).

Figure 10:
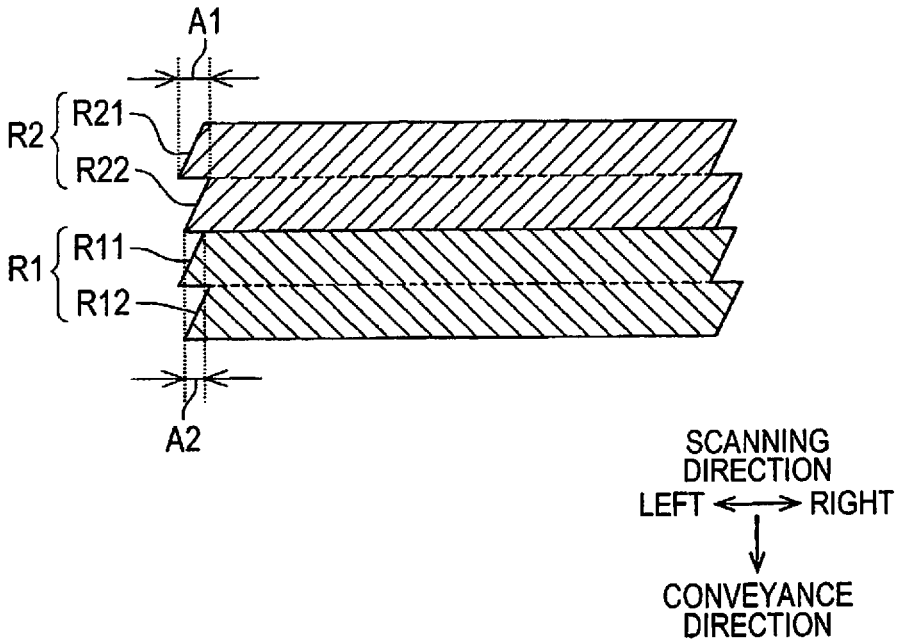
FIG. 10 is a diagram equivalent to FIG. 6B in a case where the first signal is inputted and ejection timing is changed between two nozzle groups.

In the present embodiment, when printing such an image that the resolution in the conveyance direction is the reference resolution, the ejection timing of the first nozzle group 8*a* and the second nozzle group 8*b* is set such that the above-mentioned time difference is the first time T1. As shown in FIG. 10, deviation in droplet landing positions in the scanning direction is generated in each portion between a portion R11 of the scanning range R1 corresponding to the first nozzle group 8*a* and a portion R12 of the scanning range R1 corresponding to the second nozzle group 8*b*, and between a portion R21 of the scanning range R2 corresponding to the first nozzle group 8*a* and a portion R22 of the scanning range R2 corresponding to the second nozzle group 8*b*. Due to these deviations in droplet landing positions, deviation in droplet landing positions between the scanning range R1 and the scanning range R2 (between the portion R11 and the portion R22) becomes smaller. Thus, each of a droplet-landing-position deviation amount A1 between the portion R11 and the portion R12 (or between the portion R21 and the portion R22) and a droplet-landing-position deviation amount A2 between the portion R11 and the portion R22 is smaller than a droplet-landing-position deviation amount A0 between the scanning range R1 and the scanning range R2 (the portion R11 and the portion R22) in a case where the ejection timing of the first nozzle group 8*a* and the second nozzle group 8*b* is set to the same timing (see FIG. 6B). Consequently, as an entirety of the printed image, the deviation in droplet landing positions is less easy to notice.

Because the portion R11 and the portion R12 of the scanning range R1 are portions that are scanned by the same scan printing, the droplet-landing-position deviation amount A1 between the portion R11 and the portion R12 is not so variable. In contrast, the portion R11 of the scanning range R1 and the portion R22 of the scanning range R2 are portions that are scanned by different scan printing. Thus, the droplet-landing-position deviation amount A2 between the portion R11 and the portion R22 is more variable than the droplet-landing-position deviation amount A1, due to an influence of skew of the recording sheet P relative to the conveyance direction and so on. Hence, it is preferable to set the first time T1 such that the droplet-landing-position deviation amount A2 which is more variable is smaller than the droplet-landing-position deviation amount A1 which is less variable (A1>A2).

On the other hand, when printing such an image that the resolution in the conveyance direction is higher than the reference resolution, as described above, deviation in droplet landing positions between the scanning range R3 and the scanning range R4 in the scanning direction is less easy to notice, and there is little need to change the ejection timing of the first nozzle group 8*a* and the ejection timing of the second nozzle group 8*b*. Further, if the ejection timing is changed unnecessarily between the first nozzle group 8*a* and the second nozzle group 8*b* in this case, there is a possibility that deviation in droplet landing positions in the scanning direction is generated in each portion between the portion R31 of the scanning range R3 corresponding to the first nozzle group 8*a* and a portion R32 of the scanning range R3 corresponding to the second nozzle group 8*b*, and between a portion R41 of the scanning range R4 corresponding to the first nozzle group 8*a* and the portion R42 of the scanning range R4 corresponding to the second nozzle group 8*b* (see FIG. 7B), and that image quality is deteriorated.

Hence, in the present embodiment, when printing such an image that the resolution in the conveyance direction is higher than the reference resolution, the ejection timing of the first nozzle group 8*a* and the second nozzle group 8*b* is set to the same timing (the time difference is set to zero).

In this way, the ejection timing of the nozzle groups 8*a*, 8*b* can be set appropriately based on a difference in noticeability of the deviation in droplet landing positions between the scanning ranges R, caused by a difference in the conveyance amount M of the recording sheet P.

While the disclosure has been described in detail with reference to the above aspects thereof, it would be apparent to those skilled in the art that various changes and modifications may be made therein without departing from the scope of the claims.

In the above-described embodiment, the distance between the ink ejection surface 12*a* and the recording sheet P changes depending on the position in the conveyance direction, due to a difference in the force of the corrugate plate 14 and the corrugate spur 17 for pressing the recording sheet P. However, the distance between the ink ejection surface 12*a* and the recording sheet P may change due to another reason. For example, the distance between the ink ejection surface 12*a* and the recording sheet P changes depending on the position in the conveyance direction, due to variations of vertical positions of the conveyance roller 13 and the discharge roller 16 at the time of assembly onto the printer 1, an inclination of the platen 15 at the time of assembly onto the printer 1, and so on. In this case, in a similar manner to the above-described embodiment, by setting the ejection timing of the nozzle groups 8*a*, 8*b* depending on whether the first signal is inputted or the second signal is inputted, the ejection timing of the nozzle groups 8*a*, 8*b* can be set appropriately.

Unlike the above-described embodiment, there is a case where the distance between the ink ejection surface 12*a* and the recording sheet P is smaller at an upstream side than at a downstream side in the conveyance direction. In this case, the ejection timing may be set in S303 such that the ejection timing of the second nozzle group 8*b* is advanced from the ejection timing of the first nozzle group 8*a* by the first time T1.

In the above-described embodiment, the second signal is a signal that instructs printing such an image that the resolution in the conveyance direction is twice the reference resolution, by performing so-called interlaced printing. The second signal may be another signal. For example, the second signal may be a signal that instructs printing such an image that the resolution in the conveyance direction is higher than twice the reference resolution, by performing interlaced printing. In this case, the conveyance amount M of the recording sheet P in the sheet conveyance process is set to a smaller amount than the conveyance amount in the above-described embodiment.

Figure 11A:
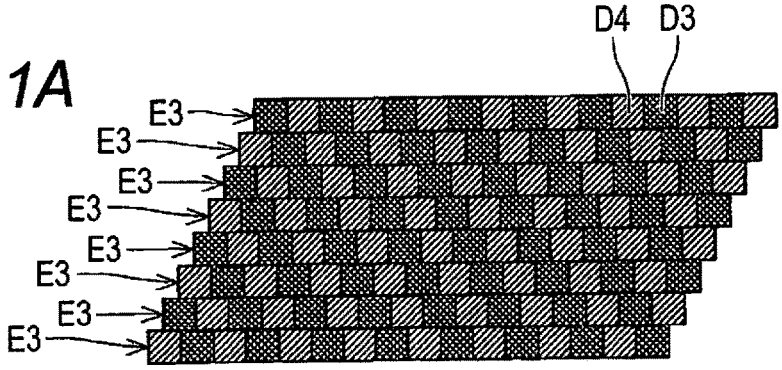
FIG. 11A is a diagram showing a dot arrangement in an overlap portion according to a modification.

Further, the second signal is not limited to a signal that performs interlaced printing. According to one modification, as shown in FIG. 11A, when the second signal is inputted, in previous scan printing, alternate dots D3 out of dots forming a dot array E3 are formed by ink ejected from the nozzles 10. In subsequent scan printing, for each dot array E3, remaining dots D4 out of dots forming the dot array E3 are formed by ink ejected from the nozzles 10 that are different from the nozzles having formed the dots D3. That is, so-called singling printing is performed in which one dot array E3 is formed by two-time scan printing.

Figure 11B:
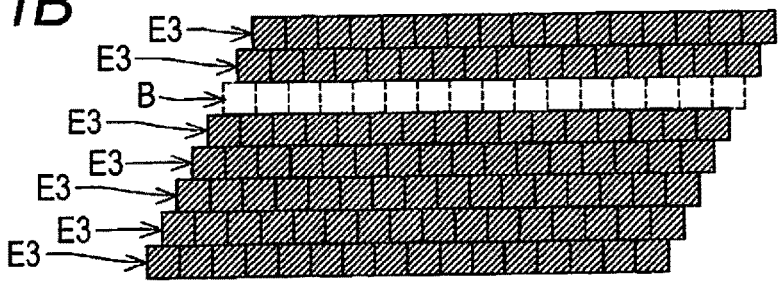
FIG. 11B is a diagram illustrating a case where no ink is ejected from a part of nozzles when forming a dot line by one-time scan printing.
Figure 11C:
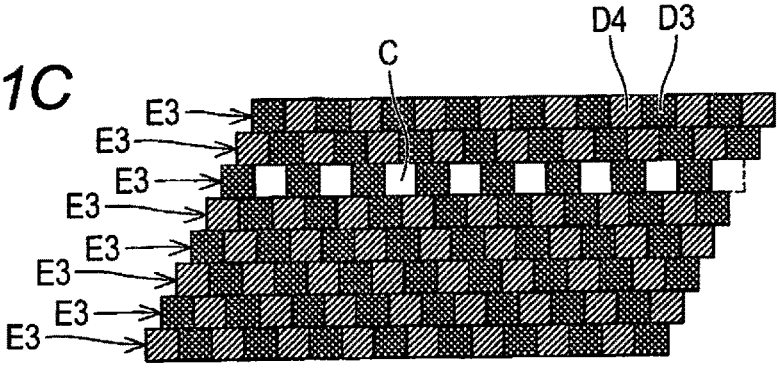
FIG. 11C is a diagram illustrating a case where no ink is ejected from a part of nozzles according to the modification.
Figure 11C:
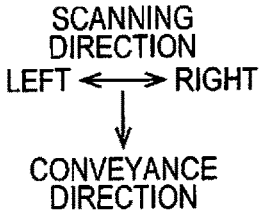

As shown in FIG. 11B, unlike this modification, in a case where one dot array E3 is formed by one-time scan printing and no ink is ejected from the nozzle 10 corresponding to the dot array E3 in scan printing, a streak region B in which no dots are formed appears on the recording sheet P, which leads to deterioration of image quality. In contrast, in this modification, one dot array E3 is formed by two-time scan printing. As shown in FIG. 11C, if no dots D4, out of dots D3, D4 forming a certain dot array E3, are formed, dots D3 are formed adjacent to regions C in which no dots D4 are formed in the scanning direction. Hence, the above-described streak region B is not created. In this case, density of the dot array E3 in which no dots D4 are formed merely decreases, and deterioration of image quality can be suppressed as much as possible. The same goes for a case where no dots D3 are formed out of dots D3, D4.

In the above modification, one dot array E3 is formed by two-time scan printing. However, one dot array may be formed by scan printing of three times or more. Further, the second signal may be a signal that instructs printing by using interlaced printing and singling printing in combination.

In the above-described embodiment, when the second signal is inputted, the ejection timing of the first nozzle group 8*a* and the second nozzle group 8*b* is set to the same timing. However, the ejection timing is not limited to this. For example, when the second signal is inputted, the ejection timing may be set such that a time difference of the ejection timing of the first nozzle group 8*a* and the second nozzle group 8*b* is a second time T2 (>0) shorter than the first time T1.

In the above-described embodiment, the first conveyance amount M1 is set to the same length as the length L of the nozzle array 9. However, the first conveyance amount M1 is not limited to this. For example, in a case where ink is ejected from only a part of nozzles of the plurality of nozzles 10 in scan printing, the first conveyance amount M1 may be set to a conveyance amount smaller than the length L of the nozzle array 9.

In the above-described embodiment, when the first signal is inputted, the two scanning ranges R1, R2 scanned by successive two-time scan printing do not overlap each other. The amount of overlapping of the two scanning ranges R1, R2 is not limited to this. For example, when the first signal is inputted, the first conveyance amount M1 may be a conveyance amount smaller than the conveyance amount in the above-described embodiment, such that the two scanning ranges R1, R2 overlap each other and that the overlap width is smaller than an overlap width used when the second signal is inputted (an overlap width of the scanning ranges R3 and R4).

Specifically, for example, each of the first signal and the second signal may be a signal that instructs performing interlaced printing, and the second signal may be a signal that instructs printing such an image that the resolution in the conveyance direction is higher than the resolution of the first signal. Alternatively, for example, each of the first signal and the second signal may be a signal that instructs performing singling printing, and the second signal may be a signal that instructs printing such that the number of times of scan printing to form one dot array when the second signal is inputted is larger than the number of times of scan printing to form one dot array when the first signal is inputted.

In the above-described embodiment, the number of the nozzles 10 forming the first nozzle group 8*a* is the same as the number of the nozzles 10 forming the second nozzle group 8*b*. However, the number of the nozzles 10 forming the nozzle groups 8*a*, 8*b* is not limited to this. The number of the nozzles 10 forming the first nozzle group 8*a* may be different from the number of the nozzles 10 forming the second nozzle group 8*b*, as long as the nozzle groups 8*a*, 8*b* are formed by one or a plurality of nozzles 10 arrayed continuously in the conveyance direction.

In the above-described embodiment, the plurality of nozzles 10 forming the nozzle array 9 is divided into the two nozzle groups 8*a*, 8*b*, and the ejection timing is changed between the first nozzle group 8*a* and the second nozzle group 8*b*. However, grouping of the plurality of nozzles 10 forming the nozzle array 9 is not limited to this. The plurality of nozzles 10 forming the nozzle array 9 may be divided into three or more nozzle groups, and the ejection timing may be changed between two nozzle groups adjacent to each other in the conveyance direction, out of the three or more nozzle groups. Each of the three or more nozzle groups is formed by one or a plurality of nozzles 10 arrayed continuously in the conveyance direction. In this case, a nozzle group at an upstream side out of two nozzle groups adjacent to each other in the conveyance direction serves as a first nozzle group, and a nozzle group at a downstream side serves as a second nozzle group.

In the above-described embodiment, two driver ICs 40*a*, 40*b* are provided. And, the driver IC 40*a* drives the nozzles 10 forming the first nozzle group 8*a*, and the driver IC 40*b* drives the nozzles 10 forming the second nozzle group 8*b*. However, the printer 1 may include a single driver IC configured to drive the first nozzle group 8*a* and the second nozzle group 8*b* independently.

In the above, this disclosure is applied to an inkjet printer that performs printing by ejecting ink from nozzles. This disclosure can be applied to another type of printer. For example, this disclosure can be applied to a printer that performs printing by ejecting liquid other than ink, such as a wiring pattern material to be printed on a wiring board.

What is claimed is:

1. A printer comprising:

a conveyor configured to convey a recording medium in a conveyance direction;

a liquid ejection head having:

a first nozzle group formed by one or a plurality of nozzles arrayed continuously in the conveyance direction; and a second nozzle group located adjacent to a downstream side of the first nozzle group in the conveyance direction, the second nozzle group being formed by one or a plurality of nozzles arrayed continuously in the conveyance direction;

a head moving device configured to move the liquid ejection head in a scanning direction intersecting the conveyance direction; and a controller configured to control the conveyor, the liquid ejection head, and the head moving device, the controller being configured to perform an ejection-timing setting process of setting, for each of the first nozzle group and the second nozzle group, ejection timing in scan printing in which the liquid ejection head ejects a liquid droplet from the plurality of nozzles while the head moving device moves the liquid ejection head in the scanning direction, the ejection-timing setting process including:

in response to receiving a first signal, setting the ejection timing such that a time difference in a same scan printing between the ejection timing of the first nozzle group and the ejection timing of the second nozzle group is a first time difference, the first signal instructing printing such that a conveyance amount of the recording medium by the conveyor between successive two-time scan printing is a first conveyance amount; and in response to receiving a second signal, setting the ejection timing such that the time difference is a second time difference shorter than the first time difference, the second signal instructing printing such that the conveyance amount is a second conveyance amount smaller than the first conveyance amount.

2. The printer according to claim 1, wherein a first overlap width is an overlap width in the conveyance direction of two scanning ranges scanned by the successive two-time scan printing when printing is performed such that the conveyance amount is the first conveyance amount;

wherein a second overlap width is an overlap width in the conveyance direction of two scanning ranges scanned by the successive two-time scan printing when printing is performed such that the conveyance amount is the second conveyance amount; and wherein the second overlap width is larger than the first overlap width.

3. The printer according to claim 2, wherein the first conveyance amount is set such that the overlap width is zero and the two scanning ranges do not overlap.

4. The printer according to claim 3, wherein the liquid ejection head has a nozzle array formed by a plurality of nozzles arrayed continuously in the conveyance direction, the plurality of nozzles including the first nozzle group and the second nozzle group; and wherein the first conveyance amount is same as a length of the nozzle array in the conveyance direction.

5. The printer according to claim 3, wherein the first signal is a signal that instructs printing such an image that a resolution in the conveyance direction is a reference resolution corresponding to a nozzle interval of the liquid ejection head in the conveyance direction; and wherein the second signal is a signal that instructs printing such an image that a resolution in the conveyance direction is higher than the reference resolution.

6. The printer according to claim 2, wherein the first signal is a signal that instructs printing to form, by one-time scan printing, one dot array in which a plurality of dots is arrayed in the scanning direction on the recording medium; and wherein the second signal is a signal that instructs printing to form, by at least two-time scan printing, the one dot array on the recording medium.

7. The printer according to claim 1, wherein the controller is configured to:

in response to receiving the second signal in the ejection-timing setting process, set the ejection timing of the first nozzle group and the second nozzle group to same timing such that the time difference is zero.

8. The printer according to claim 1, further comprising an upstream-side contactable member provided at an upstream side of the liquid ejection head in the conveyance direction, the upstream-side contactable member being capable of contacting a print surface of the recording medium, the print surface facing an ejection surface of the liquid ejection head in which the plurality of nozzles is formed.

9. The printer according to claim 8, further comprising a downstream-side contactable member provided at a downstream side of the liquid ejection head in the conveyance direction, the downstream-side contactable member being capable of contacting the print surface of the recording medium after printing is performed on the print surface, wherein force by which the downstream-side contactable member presses the recording medium is smaller than force by which the upstream-side contactable member presses the recording medium; and wherein a distance between the ejection surface and the print surface at an upstream side of the liquid ejection head in the conveyance direction is larger than a distance between the ejection surface and the print surface at a downstream side of the liquid ejection head in the conveyance direction.

10. The printer according to claim 1, further comprising:

a first driver configured to drive the liquid ejection head such that the liquid droplet is ejected from the one or plurality of nozzles forming the first nozzle group which is an upstream half of the plurality of nozzles arrayed in the conveyance direction; and a second driver configured to drive the liquid ejection head such that the liquid droplet is ejected from the one or plurality of nozzles forming the second nozzle group which is a downstream half of the plurality of nozzles arrayed in the conveyance direction, wherein the ejection timing is set individually for the one or plurality of nozzles forming the first nozzle group and the one or plurality of nozzles forming the second nozzle group.

11. The printer according to claim 1, wherein, in the ejection-timing setting process, the controller is configured to set the first time difference such that a first droplet-landing-position deviation amount is larger than a second droplet-landing-position deviation amount, the first droplet-landing-position deviation amount being a deviation of a liquid droplet landing position in the scanning direction between two portions of a scanning range that is scanned by one-time scan printing, the liquid droplet landing position being a position on the recording medium of the liquid droplet ejected from the plurality of nozzles, the second droplet-landing-position deviation amount being a deviation of the liquid droplet landing position in the scanning direction between two portions of scanning ranges that are scanned by successive two-time scan printing.

* * * * *